United States Patent [19]

Warren et al.

[11] Patent Number: 4,949,020

[45] Date of Patent: Aug. 14, 1990

[54] LIGHTING CONTROL SYSTEM

[76] Inventors: Rufus W. Warren, 9641 S. Brandt, Oak Lawn, Ill. 60653; John E. Gorman, 3520 S. 54th Ave., Cicero, Ill. 60650

[21] Appl. No.: 167,397

[22] Filed: Mar. 14, 1988

[51] Int. Cl.[5] ..... H05B 37/02

[52] U.S. Cl. ..... 315/297; 315/156; 315/307; 315/308; 315/310; 315/311; 315/DIG. 4

[58] Field of Search ..... 315/291, 294, 156, 287, 315/297, 307, 308, 309, 310, 311, DIG. 4

[56] References Cited

U.S. PATENT DOCUMENTS 3,990,000 11/1976 Digneffe ..... 315/292 X

*Primary Examiner*—David Mis

*Attorney, Agent, or Firm*—Michael G. Berkman

[57] ABSTRACT

A lighting control circuit is provided for controlling illumination and dimming of at least one light in a lighting circuit for operation at a selectable one of a plurality of applied voltages. The lighting control circuit includes a power supply circuit for receiving an AC line voltage input and for converting the AC line voltage to selectable rectified AC and DC power for delivery to the lighting control circuit. A timing generator circuit is also coupled with the power supply circuit and is responsive to a rectified AC sample from the power supply for generating and shaping an electrical timing signal. A timing comparator circuit is responsive to the electrical timing signal for generating a variable duty cycle output signal. A switching control circuit is coupled with the lighting circuit for gating current therethrough in accordance with the variable duty cycle output control signal.

12 Claims, 2 Drawing Sheets

SECTION 1

SECTION 2

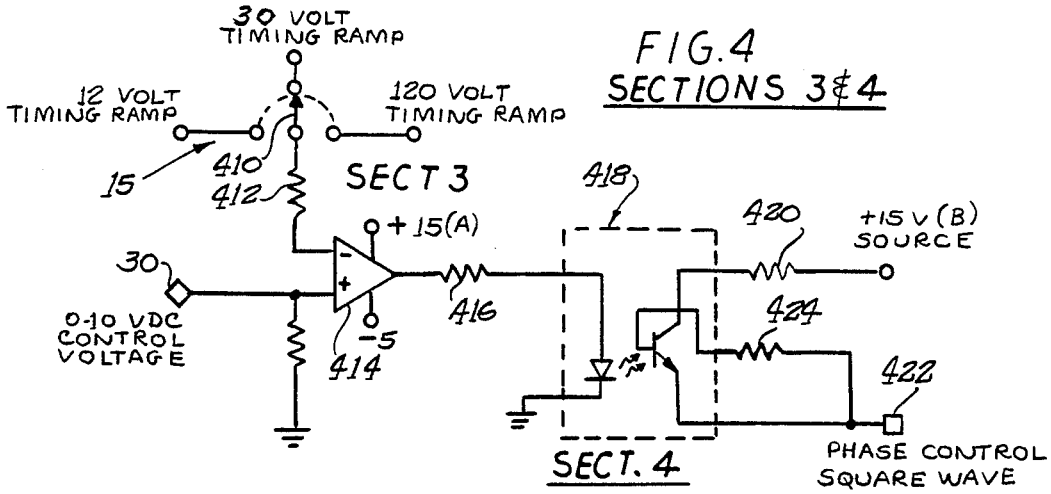
FIG.4
SECTIONS 3&4
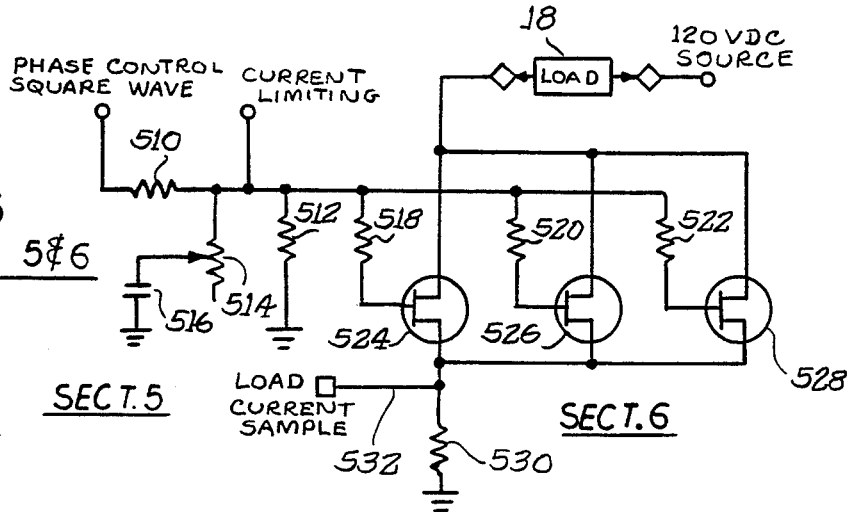
FIG.5
SECTIONS 5&6
FIG.6
SECTION 7
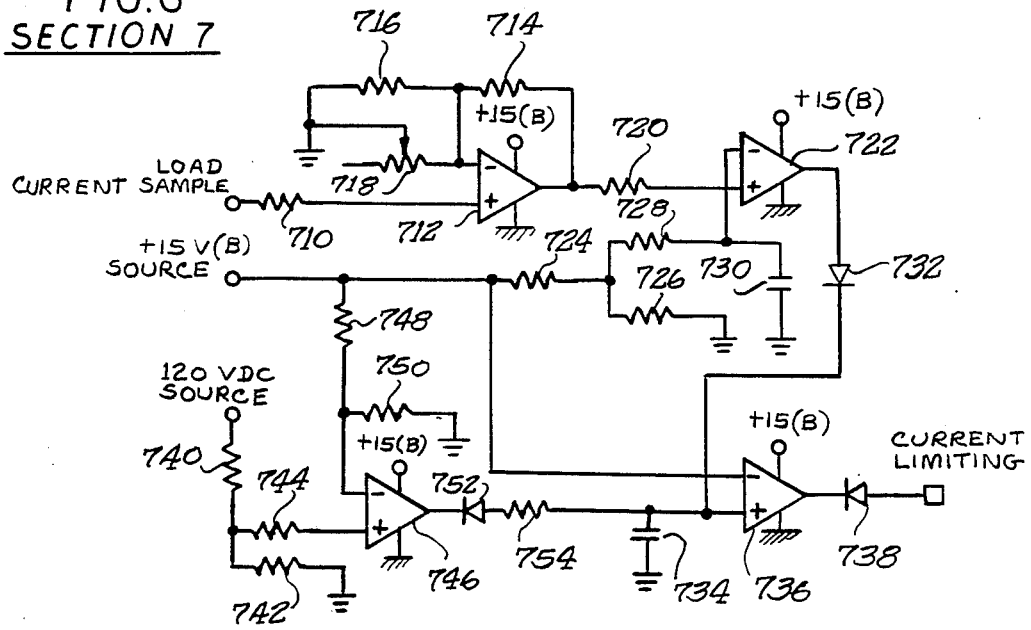

LIGHTING CONTROL SYSTEM

BACKGROUND OF THE INVENTION

This invention is directed generally to the theatrical and stage lighting arts, and more particularly to a novel and improved lighting control system which may advantageously be used in connection with the control of stage or theatrical type lighting.

Stage and theatrical lighting systems generally make use of a variety of lamp types which require a corresponding variety of power sources for their operation. Such systems or installations may include a number of different types and kinds of lighting for use at different times and/or for different applications. Such lamps may include, for example, high pressure arc lamps which require relatively high start-up voltages, i.e., which may be from two to five times the lamp's normal operating voltage, depending on the particular lamp characteristics. Such high pressure arc lamps usually require a series ballast to reduce the voltage at the lamp terminals.

Moreover, it is often desirable to provide light dimming circuits for controlling the intensity of lamps in such a stage or theatrical lighting system, either individually or collectively, as desired.

Heretofore, electrical control systems for such lighting installations have been relatively large and cumbersome, requiring many large and relatively expensive electrical components. This has been necessary in order to accommodate the desired range of control of operating voltages, dimming, and the like, for a large number of lamps, which, as indicated above, may have varying electrical operating requirements. Moreover, it has heretofore been necessary to provide a completely separate electrical control system in order to change the operating line voltage, and often even in order to operate at a different line frequency. That is, for example, standard U.S. "house current" is 120 volts 60 hertz, whereas many European systems provide 220 volts 50 hertz current. Such lighting control systems have further heretofore required relatively large, heavy and cumbersome choke coils, transformers, wire-wound rheostats, and the like to provide a desired range of start-up and dimming controls for a large number of lights in a given system or installation.

Moreover, such systems have heretofore generally been incapable of operating different lamps which may be used in such a lighting system or installation. For example, lamps of 12 volts, 28 volts, 60 volts, 90 volts or 120 volts may be selected for use in a given system. Generally speaking, the lower voltage lamps are less expensive and are often preferred by lighting technicians. Moreover, with systems heretofore in use, lamp life is often unduly shortened, because of lack of adequate control over the voltages and current supplied to the lamps during operation. Also, in the case of short circuits or overloading of the system, present control systems often fail to provide adequate protection for the lighting equipment.

Importantly, our new lighting control circuit allows the addition of dimmers for controlling a large number of high wattage lamps either individually or collectively, while avoiding much of the expensive and cumbersome equipment associated with the prior art dimmer and control systems. For example, early versions of theatrical light dimmer systems involved cabinets some eight feet tall, four feet deep and six feet wide, weighing 1,000 pounds or more. These systems were clearly not portable in nature, and moreover usually offered a maximum of only 12 dimmer controls. Moreover, these units operated only with 120 volt AC lamps and offered no flexibility whatever for lamp interchangeability. More recent technology offers more compact packages, on the order of only 12 to 20 inches in length, width and depth. However, such controls generally weigh from 65 to 85 pounds for 12 dimmers. Moreover, these newer system still do not permit lamp interchangeability, but are generally designed to operate in connection with only one lamp type.

Furthermore, the prior art systems generally did not accommodate changes in lamps or operating voltages because relatively heavy and expensive components such as power SCRs and heavy-duty toroidal filters were generally custom manufactured for operation with but a single type of lamp and at a single voltage. Larger dimmer systems generally were proportionately larger, more complex and more expensive than the above-mentioned 12 dimmer type of system. For example, many installations, both permanent and portable, require as many as from 96 to 200 dimmer modules or dimmer controls. Such systems, generally referred to in the art as a "high density rack", are both heavy, complex and expensive, and yet offer surprisingly little flexibility in their operation. By way of example, high density racks systems presently available do not offer switchable lamp voltages or short circuit protection. The approximate weight per dimmer control of these systems runs from three to five pounds. Moreover, such systems require a minimum of a 10 watt load for safe operation and generally offer output power at only 120 volts.

OBJECTS AND SUMMARY OF THE INVENTION

Accordingly, it is a general object of this invention to provide a novel and improved lighting and power control circuit which generally overcomes the above-noted shortcomings of the prior art systems.

A related object is to provide a control circuit in accordance with the foregoing object which may readily be used with a number of different voltage lamps without unnecessary duplication of complex and expensive circuit components.

Another related object is to provide a control circuit in accordance with the foregoing general object which is capable of operating a lighting system on a wide range of available power sources or "house currents", without changing lamps, using expensive transformers, or the like.

A further related object is to provide a control system in accordance with the foregoing general object which advantageously promotes longer lamp life and automatically shuts down in the case of short circuit or overload conditions to protect the connected lighting circuits.

A further object is to provide a control circuit in accordance with the foregoing general object which is considerably smaller in size and lighter in weight than prior art systems.

Briefly, and in accordance with the foregoing objects, a lighting control circuit for controlling illumination and dimming of at least one light in a lighting circuit for operation at a selectable one of a plurality of applied voltages comprises power supply means for receiving an AC line voltage input and for converting said AC line voltage to selectable rectified AC and DC power for delivery to said lighting control circuit; timing generator circuit means coupled with said power supply means and responsive to a rectified AC sample from said power supply means for generating and shaping an electrical timing signal; timing comparator circuit means responsive to said electrical timing signal for generating a variable duty cycle output signal; and switching circuit means coupled with said lighting circuit for gating current therethrough and having a control input coupled in circuit with said timing comparator circuit means for gating said current in accordance with said variable duty cycle output signal.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

FIG. 4 is a schematic circuit diagram illustrating details of timing comparator and line voltage isolation sections of the circuit of FIG. 1;

FIG. 5 is a schematic circuit diagram illustrating details of waveform shaping and power control sections of the circuit of FIG. 1; and FIG. 6 is a schematic circuit diagram illustrating details of a current limiting section of the circuit of FIG. 1.

DETAILED DESCRIPTION OF THE ILLUSTRATED EMBODIMENT

Figure 1:
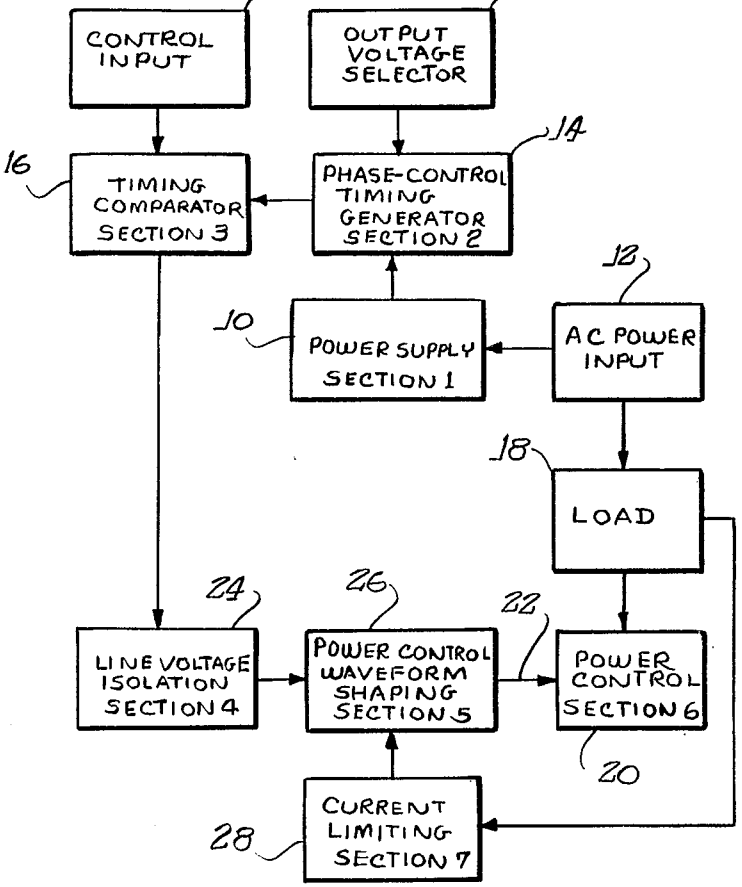
FIG. 1 is a schematic circuit illustration, in block diagrammatic form, showing a lighting control circuit in accordance with the present invention.

Turning now to the drawings and initially to FIG. 1, there is illustrated a lighting control circuit in accordance with the invention, in block diagrammatic form. As illustrated in FIG. 1, the lighting control circuit in accordance with the invention includes a power supply means or section 10. This power supply is adapted for receiving an AC line voltage input, for example from an AC line or power input source 12, and for converting this AC line voltage to selectable rectified AC and DC power for delivery to the lighting control circuit. A timing generator circuit means (phase-control timing generator) 14 is coupled with the power supply 10 and is responsive to a rectified AC sample from the power supply for generating and shaping an electrical timing signal.

A timing comparator circuit means 16 is coupled with the timing generator circuit 14 and is responsive to the electrical timing signal therefrom for generating a variable duty cycle output signal. The lighting circuit or load 18 is coupled between the AC power source or input 12 and a power control circuit means or section 20. This power control circuit 20 includes switching circuit means coupled with the lighting circuit or load 18 for gating current therethrough. A control input 22 of the circuit 20 is coupled in circuit with the timing comparator circuit 16, by way of intermediate circuits to be described later, for gating the current through the load generally in accordance with the variable duty cycle output of the timing comparator circuit 16.

Preferably, the control circuit in accordance with the invention also includes a line voltage isolation means or section 24. This isolation means 24 is interposed between the timing comparator circuit 16 and the switching circuit means of power control section 20 for isolating the AC line connected circuit portions from the low voltage circuit portions of the control circuit or system. In the illustrated embodiment a further, power control or waveform shaping circuit means 26 is also interposed between the timing comparator circuit 16 and switching circuit means of the power control section 20. In the embodiment illustrated herein, this power control or waveform shaping circuit section is located subsequent to the line voltage isolation section 24. The waveform shaping circuit means 26 operates to regulate the switching time of the switching circuit means.

Further in accordance with the preferred form of the invention illustrated herein, a current limiting or comparator circuit means or section 28 is also coupled with the switching circuit means, and with the power control waveform shaping circuit 26. This current limiting comparator circuit means or section 28 generally includes means for sensing the load current through the load 18 and for comparing the load current, as gated by the switching circuit means the power control circuit 20, with a selectable threshold value. The current limiting section and power control waveform shaping section 28, 26 further operate to control the switching circuit means so as to limit current flow in the load or lighting circuit in accordance with this comparison.

Referring now more particularly to the individual functional blocks indicated in the diagram of FIG. 1, the power supply section 10 receives AC power and produces DC voltages for the low voltage lighting and control circuits as well as a sine wave AC sample for the timing generator section 14. The power supply also includes a high voltage D.C. supply for portions the line-connected circuits and for the load. A full wave rectified signal from the power supply is used to synchronize operation of the phase-control timing generator to the AC line voltage and to thereby shape the timing signal so that its DC voltage at any time corresponds generally to the RMS voltage of the AC line voltage.

The timing signal, preferably in the form of a ramp, is fed to the timing comparator circuit 16. The comparator compares the timing ramp signal from the phase-control timing generator 14 to a control voltage generated at a control input 30 to thereby generate a variable duty cycle square wave control signal. The line voltage isolation circuit means 24 feeds this variable duty cycle square wave through to the following circuitry while isolating these low voltage circuits from the line-connected circuits. Accordingly, an output square wave which corresponds to the input variable duty cycle square wave is fed to the power control waveform shaping circuit 26. The square wave signal is altered by the circuit 26 to control the switching time of the power control section 20. Accordingly, the power control section 20 acts as a switching circuit or gating circuit so as to gate or control the flow of current through the lighting circuit or load 18.

Advantageously, as will be more fully explained hereinbelow, the rate of change of the control voltage is limited, so that the load current does not change rapidly enough to cause interference and distortion on the AC power line. Moreover, the load current is sampled and fed to the current limiting section 28, wherein it is compared to a selected threshold value. If this threshold is exceeded, a latch is set for the duration of the half-cycle to prevent further current flow in the power control circuit 20. The output of this latch is then fed to waveform shaping circuit 26 so as to effectively cut off the power control circuit 20, thus shutting off current flow in the load or lighting circuits 18.

Reference is now invited to FIGS. 2 through 6, in connection with which, a more detailed description of the construction and operation of the circuits of FIG. 1 will be given.

Figure 2:
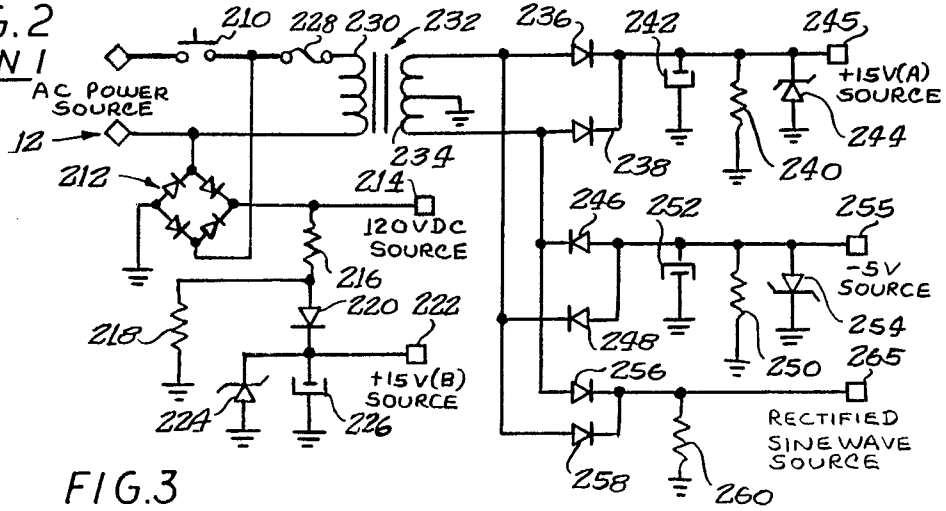
FIG. 2 is a schematic circuit diagram illustrating details of a power supply section of the circuit of FIG. 1.

Referring initially to FIG. 2, the power supply section (section 1) receives AC power from the AC power input 12 which may be, for example, a 120 Volt AC, 60 hertz "household" current source. Preferably the current is passed through a circuit breaker 210 which will open in the case of overload anywhere in the non-isolated portion of the circuit. The AC current is then rectified by a diode bridge 212 to provide a 120 volt DC source 214, part of which passes through a voltage divider made up of resistors 216 and 218 and a diode 220 to make up a 15 volt (B) DC source 222. Preferably, this 15 volt source 222 is regulated by a zener diode 224 and a filter capacitor 226. It should be noted that connection of resistor 218 to ground assures that the 120 volt DC source will drop to zero volts DC during the zero crossing of each half cycle of the AC power source.

Part of the AC current from the power source 12 also flows through a fuse 228 to the primary winding 230 of a transformer 232, which converts the voltage to 24 volts AC, with a center tap connected as isolated common in the secondary winding 234. Part of the current from the secondary 234 is rectified by diodes 236, 238, filtered by resistor 240 and capacitor 242 and regulated by zener diode 244 to provide a positive 15 volt(A) source 245. The secondary coil 234 also provides a current which is rectified by diodes 246, 248, filtered by resistor 250 and capacitor 252 and regulated by zener diode 254 to form a negative 5 volt source 255. A final part of the secondary current in secondary coil 234 is rectified by diodes 256 and 258 to provide a rectified sine wave source 265 across resistor 260. The respective voltage sources provided by the power supply of FIG. 2 are utilized at various supply points in the ensuing circuits, as indicated in the respective circuit diagrams.

Figure 3:
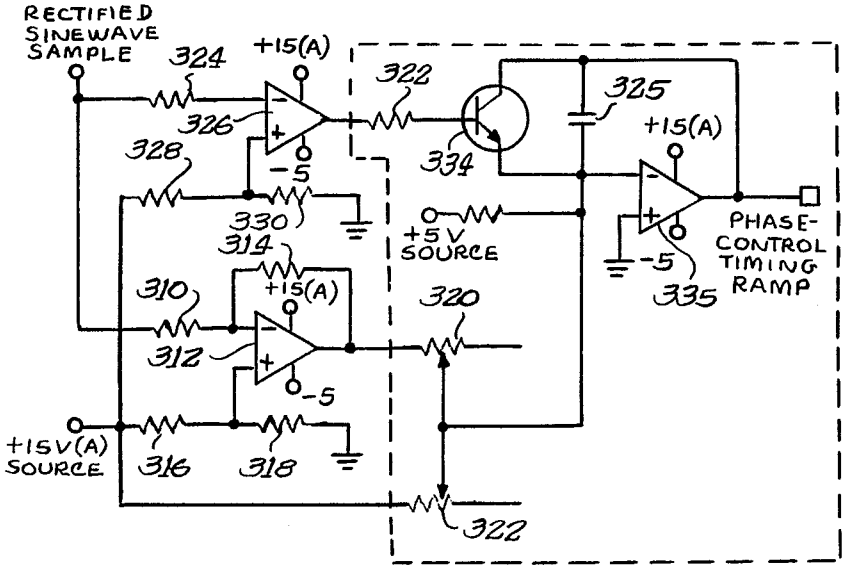
FIG. 3 is a schematic circuit diagram illustrating details of a phase control timing generator section of the circuit of FIG. 1.

FIG. 3 comprises a detailed schematic circuit diagram of the phase-control timing generator 14 (section 2) of FIG. 1. Referring now to FIG. 3, the rectified sine wave sample from source 265 passes through a resistor 310 to the inverting input of an operational amplifier 312 where it is inverted and amplified by the ratio of the values of resistors 310 and 314, and level-shifted by the voltage divider consisting of resistors 316, 318. The output of the op amp 312 is summed and integrated with the output of a variable voltage divider made up of resistors 320 and 322, by capacitor 325 and operational amplifier 335. The output of op amp 312 is fed through a variable voltage divider made up of respective variable resistors 320 and 322.

The rectified sine wave sample also passes through an isolation resistor 324 to the inverting input of a further operational amplifier 326 where it is compared to a percentage of the 15 volt(A) voltage divided by resistors 328, 330, the junction of which is coupled to the non-inverting input of a comparator 326. The output of comparator 326 will be low except at the half-cycle zero-crossing point, when it will go positive and pass through resistor 332 to turn on the base of transistor 334. This will in turn discharge the capacitor 325 and reset the phase-control timing signal which is produced at the output of op amp 335. It should be noted that the phase control timing signal thus forms a constantly rising ramp-type signal which will ramp up until it either reaches the positive supply rail or is reset by the turn-on of transistor 334 as described above.

Reference is invited next to FIG. 4, wherein the details of the timing comparator 16 (section 3) and line voltage isolation 24 (section 4) circuits is shown. It should be noted at this point that the portion of the circuit of FIG. 3 enclosed in dashed line may be repeated as many times as desired to form a plurality of phase control timing ramps at different output voltage levels, as desired. Accordingly, and turning again to FIG. 4, an output voltage selector, indicated by reference numeral 15 in FIG. 1, comprises a multiple position switch 410, which in FIG. 4 has been illustrated as a three position single pole switch. Three selectable voltage timing ramps are illustrated, by way of example, as being 12 volt and 120 volt.

However more or fewer such selectable voltages at any desired value may be selected and provided in the manner illustrated and described above with reference to FIG. 2, without departing from the invention.

Accordingly, the circuit portion within the dashed line in 3 may be duplicated as many times as desired to produce a desired number of repeating ramp or "saw tooth" output signals, each of which corresponds to a different selectable output voltage at the load 18. Accordingly, switch 410 selects one of these timing ramps or saw tooth signals which then passes through an isolation resistor 412 to the inverting input of a comparator 414. The selected ramp is compared to a selectable control voltage which is provided at the control input 30, which corresponds to control input 30 of FIG. 1. This control voltage may be supplied by low voltage wiring from a remote location, if desired. The output of comparator 414 is a variable duty cycle square wave which passes through a current limiting resistor 416 to an optical isolator circuit 418 which comprises the line voltage isolation circuit 24 (section 4). This energizes an internal LED of the optical isolator 418 which in turn turns on an internal phototransistor so as to draw a current from the 15 volt(B) source through a resistor 420. This in turn pulls up the phase control square wave output 422. Part of the current is passed back through resistor 424 to stabilize the internal phototransistor of the optical isolator 418.

This phase control square wave passes through an RC filter composed of resistors 510, 512, variable resistor 514 and capacitor 516 (see FIG. 5). This RC filter alters the rise and fall times of the square wave which is then fed through respective isolation resistors 518, 520 and 522 to the respective gates of power transistors 524, 526 and 528. This in turn limits the rate of current change through the power transistors which reduces the distortion imposed on the AC line voltage and eliminates the need for an inductive filter choke in series with the load. The load current passes through a resistor 530 which converts the load current to a small sample voltage ("load current sample") at a sample point 532. The circuit of FIG. 5 thus comprises the power control wave form shaping circuit 26 (section 5) and power control circuit 20 (section 6) of the circuit of FIG. 1.

Turning next to FIG. 6, the current limiting circuit 28 (section 7) of FIG. 1 is illustrated. The load current sample from sample point 532 is introduced through an isolation resistor 710 to the non-inverting input of an operational amplifier 712 where it is inverted and amplified by the ratio of values of resistor 714 to resistors 716 and 718, the latter being a variable resistor so as to provide a wide range of amplification. The amplified and inverted voltage is passed through a further isolation resistor 720 to the non-inverting input of a comparator 722 where it is compared to a threshold voltage, set by a voltage divider comprising resistors 724 and 726 and filtered by resistor 728 and capacitor 730.

Accordingly, if the current exceeds the threshold value, the output of comparator 722 swings high and passes through diode 732 which in turn charges capacitor 734. This also swings the output of a following comparator 736 negative and, through output diode 738 overrides the phase control square wave and switches off the power transistors 524, 526 and 528 immediately. This in turn drops the load current to zero and changes the output of comparator 722 back to low. However, diode 732 allows capacitor 734 to retain its charge and keep the flow of current switched off.

In order to allow conduction during the next half-cycle, the full-wave rectified AC voltage (120 VDC source) is introduced by way of a voltage divider comprising resistors 740 and 742 and a current limiting resistor 744 to the non-inverting input of a comparator 746. There, the divided voltage is compared to a portion of the 15 volt(B) source voltage which proportion is set by voltage divider 748, 750. The output of comparator 746 will swing negative during the zero crossing of the AC voltage and discharge the capacitor 734 through diode 752 and resistor 754.

It will be appreciated from the foregoing description that the novel lighting control system of the invention permits use of a relatively simple, low-voltage electronic circuit which may be readily configured to accommodate any desired number of output voltage levels for various lighting circuits or other loads. The number and values of the output voltages may be varied as desired, as noted above, by the selection of the number and voltage levels of the relatively simple and easily duplicated circuit portion as indicated in dashed line in FIG. 3, as noted above.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

We claim:

1. A lighting control circuit for controlling illumination and dimming of at least one light in a lighting circuit, said lighting control circuit comprising: power supply means for receiving an AC line voltage input and for converting said AC line voltage to selectable rectified Ac and DC power supplies; timing generator circuit means coupled with said power supply means and responsive to a rectified Ac power supply from said power supply means for generating and shaping an electrical timing signal; timing comparator circuit means responsive to said electrical timing signal and to a selectable control voltage for generating a variable duty cycle output signal; switching circuit means coupled with said lighting circuit for gating current therethrough and having a control input coupled in circuit with said timing comparator circuit means for gating said current in accordance with said variable duty cycle output, and current limiting comparator circuit means coupled with said switching circuit means and with said lighting circuit means for comparing the current gated by said switching circuit means with a selectable threshold value, and for controlling said switching circuit means to limit current flow in said lighting circuit in accordance with said comparison.

2. A lighting control circuit in accordance with claim 1 wherein said timing generator circuit means includes zero-crossing detector means and integrator circuit means for together controlling the instantaneous DC voltage of said electrical timing signal to form a ramp signal of repeating cyclical form, in synchronization with the AC RMS line voltage.

3. A lighting control circuit in accordance with claim 1 and further including line voltage isolation circuit means interposed between said timing comparator circuit means and said switching circuit means for isolating AC line-connected circuit portions from low-voltage circuit portions.

4. A lighting control circuit in accordance with claim 1 wherein said switching circuit means includes power transistor means coupled for gating current through said lighting circuit and further including waveform shaping circuit means coupled between said timing comparator circuit means and said switching circuits for regulating the switching time of said power transistor means.

5. A lighting control circuit in accordance with claim 1 wherein said timing generator circuit means further includes means for producing a plurality of timing signals at different voltage levels, corresponding to different desired applied voltages for said lighting circuit, and further including output voltage selector means coupled intermediate said timing generator circuit means and said timing comparator circuit means for selecting one of said plurality of applied voltages corresponding to the applied voltage required for a given lighting circuit.

6. A lighting control circuit in accordance with claim 3 wherein said line voltage isolation circuit means comprises optical isolator circuit means.

7. A lighting control circuit according to claim 1 wherein said timing generator circuit means comprises a ramp generator circuit for generating a ramp signal which rises until it reaches a positive supply voltage or is reset by a reset signal, and zero-crossing detector circuit means for producing said resetting signal at the half-cycle zero-crossing point of the applied AC power voltage, thereby substantially synchronizing the phase control timing ramp signal with the AC power voltage applied.

8. A lighting control circuit in accordance with claim 7 wherein said timing comparator circuit means compares said ramp signal with a control voltage input to thereby form a variable duty cycle square wave.

9. A lighting control circuit in accordance with claim 8 and further including waveform shaping circuit means coupled between said timing comparator circuit means and said switching circuit means for regulating the rise and fall times of the square wave so as to limit the rate of current change through said switching circuits, and for reducing distortion imposed on the AC line voltage to thereby eliminate the need for an inductive filter choke in series with the lighting circuit load.

10. A lighting control circuit in accordance with claim 1 wherein said current limiting comparator circuit means switches off said switching circuit means to drop the load current through the lighting circuit to zero when the current gated by the switching circuit means exceeds the selectable threshold value, and includes clamping circuit means for holding the current in said lighting circuit to substantially zero until the next zero-crossing of the AC supply voltage.

11. A lighting control circuit for controlling illumination and dimming of at least one light in a lighting circuit, said lighting control circuit comprising: power supply means for receiving an AC line voltage input and for converting said AC line voltage to selectable rectified Ac and Dc power supplies; timing generator circuit means coupled with said power supply means and responsive to a rectified AC power supply from said power supply means for generating and shaping an electrical timing signal; timing comparator circuit means responsive to said electrical timing signal for generating a variable duty cycle output signal; switching circuit means coupled with said lighting circuit for gating current therethrough in accordance with said variable duty cycle output signal; and line voltage isolation circuit means interposed between said timing comparator circuit means and said switching circuit means for isolating AC line-connected circuit portions from low-voltage circuit portions.

12. A lighting control circuit for controlling illumination and dimming of at least one light in a lighting circuit said lighting control circuit comprising: power supply means for receiving an AC line voltage input and for converting said AC line voltage to selectable rectified AC and Dc power supplies; timing generator circuit means coupled with said power supply means and responsive to a rectified AC power supply from said power supply means for generating and shaping an electrical timing signal; timing comparator circuit means responsive to said electrical timing signal for generating a variable duty cycle output signal; and switching circuit means coupled with said lighting circuit for gating current therethrough in accordance with said variable duty cycle output signal; said switching circuit means including power transistor means coupled for gating current through said lighting circuit and further including waveform shaping circuit means coupled between said timing comparator circuit means and said switching circuits for regulating the switching time of said power transistor means.

* * * * *